US005948238A

United States Patent [19]

Sartori et al.

[11] Patent Number: 5,948,238

[45] Date of Patent: Sep. 7, 1999

[54] METAL COMPOUNDS AS ACCELERATORS FOR PETROLEUM ACID ESTERIFICATION

[75] Inventors: Guido Sartori, Annandale; David W. Savage, Lebanon; Saul C. Blum, Edison; David C. Dalrymple, Bloomsbury; William E. Wales, Phillipsburg, all of N.J.

[73] Assignee: Exxon Research And Engineering Co., Florham Park, N.J.

[21] Appl. No.: 09/167,154

[22] Filed: Oct. 6, 1998

[51] Int. Cl.[6] ..... C10G 29/00; C23F 11/00; C10L 1/18; C09K 15/00

[52] U.S. Cl. ..... 208/47; 208/85; 208/205; 208/263; 208/291; 208/295; 252/387; 252/389.52; 252/389.53; 252/389.54; 252/389.61; 507/939

[58] Field of Search ..... 252/389.52, 389.53, 252/389.54, 389.61, 387; 208/47, 14, 15, 18, 85, 204, 205, 263, 291, 295; 507/939

[56] References Cited

U.S. PATENT DOCUMENTS

| | | | |
|---|---|---|---|
| 2,302,281 | 11/1942 | Watkins | 508/447 |
| 2,769,767 | 11/1956 | Fierce et al. | 196/41 |
| 2,773,919 | 12/1956 | Millikan | 208/46 |
| 4,199,440 | 4/1980 | Verachtert | 208/230 |
| 4,300,995 | 11/1981 | Liotta | 208/403 |
| 5,169,598 | 12/1992 | Zetlmeisl et al. | 422/16 |
| 5,252,254 | 10/1993 | Babaian-Kibala et al. | 208/47 |
| 5,472,638 | 12/1995 | McLaughlin et al. | 252/189 |
| 5,643,439 | 7/1997 | Sartori et al. | 208/47 |
| 5,683,626 | 11/1997 | Savtovi et al. | 252/389.62 |

FOREIGN PATENT DOCUMENTS

2024574 C1 12/1994 Russian Federation .

OTHER PUBLICATIONS

E.Q. Camp, et al., "Neutralization as a Means of Controlling Corrosion of Refinery Equipment", presented at the Fifth Annual Conference, National Association of Corrosion Engineers, Apr. 11–14, Cincinnati, Ohio, (Feb. 1950) vol. 6, pp. 39–44.

*Primary Examiner*—Joseph D. Anthony
*Attorney, Agent, or Firm*—Estelle C. Bakun

[57] ABSTRACT

The present invention relates to a process for reducing the acidity of a petroleum oil containing organic acids comprising treating said petroleum oil containing organic acids with an effective amount of an alcohol at a temperature and under conditions sufficient to form the corresponding ester of said alcohol and wherein said treatment is conducted in the presence of a metal carboxylate.

13 Claims, No Drawings

METAL COMPOUNDS AS ACCELERATORS FOR PETROLEUM ACID ESTERIFICATION

FIELD OF THE INVENTION

The present invention relates to a process for reducing the acidity and corrosivity of petroleum oils.

BACKGROUND OF THE INVENTION

Whole crudes and crude fractions with high organic acid content such as those containing carboxylic acids, specifically naphthenic acids are corrosive to the equipment used to extract, transport and process the crudes. Solutions to this problem have included use of corrosion-resistant alloys for equipment, use of corrosion inhibitors, and neutralization of the organic acids with various bases.

Efforts to minimize organic acid corrosion have included a number of approaches by neutralizing and removing the acids from the oil. For example, U.S. Pat. No. 2,302,281 and Kalichevsky and Kobe in Petroleum Refining with Chemicals (1956), Chapter 4, disclose various base treatments of oils and crude fractions, e.g., using bases such as ammonia (page 170). U.S. Pat. No. 4,199,440 discloses treatment of a liquid hydrocarbon with a dilute aqueous alkaline solution, specifically dilute aqueous NaOH or KOH. U.S. Pat. No. 5,683,626 teaches treatments of acidic crudes with tetraalkylammonium hydroxide and U.S. Pat. No. 5,643,439 uses trialkylsilanolates. PCT US96/13688, US/13689 and US/13690 (Publication WO 97/08270, 97/08271 and 97/08275 dated Mar. 6, 1997) teach the use of Group IA and Group IIA oxides and hydroxides to treat whole crudes and crude fractions to decrease naphthenic acid content. U.S. Pat. No. 4,300,995 discloses the treatment of carbonaceous material particularly coal and its products, heavy oils, vacuum gas oil, petroleum resids having acidic functionalities with a dilute quaternary base, such as tetramethylammonium hydroxide in a liquid (alcohol or water). This patent was aimed at improving yields and physical characteristics of the products and did not address the question of acidity reduction.

It is known that mineral acid catalyze nucleophilic additions (esterification) of carboxylic acids with alcohols can occur. (See, for example, Streitwieser, Jr. and Heathcock, Introduction to Organic Chemistry, second edition, Chapter 18, page 516). However, the addition of such mineral acids to esterify organic acids in petroleum oils would be counterproductive since acid would be added to the oil to achieve an acid reduction. One would merely be replacing one acid with another.

While the above processes have achieved varying degrees of success there is a continuing need to develop more efficient methods for treating acidic crudes.

SUMMARY OF THE INVENTION

The present invention relates to a process for reducing the acidity of a petroleum oil containing organic acids comprising treating said petroleum oil containing organic acids with an effective amount of an alcohol at a temperature and under conditions sufficient to form the corresponding ester of said alcohol and wherein said treatment is conducted in the presence of a metal carboxylate.

The present invention may suitably comprise, consist or consist essentially of the elements disclosed and may be practiced in the absence of an element not disclosed.

DETAILED DESCRIPTION OF THE INVENTION

Some petroleum oils contain organic acids that contribute to corrosion or fouling of refinery equipment and that are difficult to separate from the processed oil. The organic acids generally fall within the category of naphthenic and other organic acids. Naphthenic acid is a generic term used to identify a mixture of organic acids present in petroleum stocks. Naphthenic acids may be present either alone or in combination with other organic acids, such as phenols. Naphthenic acids alone or in combination with other organic acids can cause corrosion at temperatures ranging from about 65° C. (150° F.) to 420° C. (790° F.). Reduction of the naphthenic acid content of such petroleum oils is a goal of the refiner.

The petroleum oils that may be treated in accordance with the instant invention are any organic acid-containing petroleum oils including whole crude oils and crude oil fractions that are liquid, liquifiable or vaporizable at the temperatures at which the present invention is carried out. As used herein the term whole crudes means unrefined, non-distilled crudes. The petroleum oils are preferably whole crudes.

Unexpectedly, Applicants have discovered that petroleum oils containing organic, specifically naphthenic acids, may have their naphthenic acid content reduced simply by treatment with an effective amount of alcohol in the presence of an effective amount of a metal salt of a carboxylic acid. The treatment is conducted under conditions capable of converting the alcohol and acid to the corresponding ester. For example, if methanol is used, the methanol will be converted to methyl ester. Hence treatment temperatures will preferably range from about ambient to about 450° C. The temperature utilized should not exceed the cracking temperature of the petroleum oil if temperatures of greater than 450° C. are used. Pressures of from about 100 to 300 kPa are typical and generally result from the system itself.

Optionally, any excess of methanol may be recovered and reused in either a batch or continuous process to contact additional untreated petroleum oil. Such recovery is readily accomplished by the skilled artisan.

Beneficially, the treatment with alcohol produces a treated crude that will produce low ash when burned unlike petroleum oils treated with inorganic oxides and hydroxides. Indeed, the esters produced from reaction of the acids and alcohols may be left in the treated petroleum oil without any detrimental effect.

The alcohols usable herein are commercially available. The alcohols may be selected from alkanols and alkane diols. The alkanols are preferably those having $C_1$ to $C_6$ carbons and the alkane diols are preferably those having $C_2$ to $C_6$ carbons. Preferably, the alcohol will be methanol or ethanol, most preferably methanol. The alcohols usable need only be capable of forming a thermally and hydrolytically stable ester with the acids contained in the petroleum oil being treated. Choice of alcohols meeting the above criteria is easily accomplished by the skilled artisan.

Treatment of the petroleum oils includes contacting the petroleum oil with an alcohol as described herein. Contacting times depend on the nature of the petroleum oil being treated and its acid content. Typically, contacting will be carried out from minutes to several hours. As noted previously, the contact time is that necessary to form an ester of the alcohol and acid.

The metal salts of carboxylic acids utilized herein serve to accelerate the esterification of the alcohol and organic acids in the petroleum oil being treated. Likewise, there is no harm in accelerating the esterification in oils where the esterification would occur at an acceptable rate in the absence of the metal salt of carboxylic acids.

The metal salts of carboxylic acids which can be utilized in the instant invention include, but are not limited to, metal naphthenates, palmitates, stearates and mixtures thereof. The metals of the metal salts of carboxylic acids may be selected from Groups IA, IIA, IIIA, IIIB, IVA, IVB, VIIB, and VIIIB (see *Basic Inorganic Chemistry*, Cotton & Wilkinson, 1976), preferably Li, Na, K, Mg, Ca, Sc, La, Ti, Zr, Mn, Co, Al, Cs, and mixtures thereof.

The metal salts may be added directly to the crude oil being treated or may be formed in situ by addition of a metal derivative, e.g., oxide, hydroxide or acetylacetonate, that reacts with the naphthenic acids in the crude to form a metal salt.

Alternatively, a crude already containing metal carboxylates, e.g., calcium naphthenates, may be blended with the crude having the acids to be esterified.

The amount of metal carboxylate can range from about 0.5 to about 20 milliequivalents of metal carboxylate per kg of petroleum oil being treated.

The molar ratio of alcohol to organic acid in the petroleum oil can range from about 0.5 to about 20, preferably, about 1 to about 15.

The extent of esterification can be estimated by infrared spectroscopy, which shows a decrease in intensity of the 1708 $cm^{-1}$ band, attributed to carboxylic groups. A new band appears at 1742 $cm^{-1}$, attributed to ester groups. In some cases, naphthenic acids are partly converted to ketones, which give a band around 1715 $cm^{-1}$. To distinguish between a ketone and a carboxyl band, the sample is treated with triethylamine, which eliminates the carboxyl band and leaves the ketone band unchanged.

The concentration of acid in the crude oil is typically expressed as an acid neutralization number or acid number, which is the number of milligrams of KOH required to neutralize the acidity of one gram of oil. It may be determined according to ASTM D-664. Any acidic petroleum oil may be treated according to the present invention, for example, oils having an acid neutralization number of from 0.5 to 10 mg KOH/g acid. Typically, the decrease in acid content may be determined by a decrease in the neutralization number or in the intensity of the carboxyl band in the infrared spectrum at about 1708 $cm^{-1}$. Petroleum oils with acid numbers of about 1.0 and lower are considered to be of moderate to low corrosivity. Petroleum oils with acid numbers greater than 1.5 are considered corrosive. Acidic petroleum oils having free carboxyl groups may be effectively treated using the process of the present invention.

Petroleum oils are very complex mixtures containing a wide range of contaminants and in which a large number of competing reactions may occur. Thus, the reactivity of particular compounds to produce the desired neutralization is not predictable. Unexpectedly, in the current process the acidity of the oil is effectively reduced by the simple addition of alcohol in the presence of a metal carboxylate. The simplicity of the process makes it highly desirable. Indeed, not only is the acidity of the petroleum oil reduced, but the oil is concurrently rendered less corrosive.

The residual acidity of an esterified crude can also be estimated by titration according to ASTM D-664.

The present invention may be used in applications in which a reduction in the acidity of an acidic petroleum oil would be beneficial.

The present invention may be demonstrated with reference to the following non-limiting examples.

EXAMPLE 1

This example is for comparative purposes only.

The reaction apparatus was a 300 ml autoclave. 100 g of Heidrun, having a total acid number of 2.7 mg KOH/g of oil, determined according to ASTM D-664, and 1.51 g of methanol were put into the autoclave, which was then closed. The autoclave was heated to 350° C. while stirring. Samples were taken 10, 20, 60 and 120 minutes after reaching 350° C. The following table gives the residual acidities.

| Time, minutes | Residual Acidity, mg KOH/g |
|---|---|
| 10 | 2.1 |
| 20 | 1.9 |
| 60 | 1.4 |
| 120 | .6 |

EXAMPLE 2

The reaction apparatus was the same autoclave used in Example 1. 50 g of Heidrun and 50 g of Bolobo 2–4, having a total acid number of 7.2 mg KOH/g, determined according to ASTM D-664, and containing 137 parts per million of calcium, were put into the autoclave.

The blend had a total acid number of 5.1 mg KOH/g. 2.82 g of methanol were added, then the autoclave was closed and heated to 350° C. Samples were taken after the temperature was reached. The following table gives the results.

| Time, minutes | Residual Acidity, mg KOH/g |
|---|---|
| 10 | .8 |
| 20 | .4 |
| 30 | .3 |

Comparison with Example 1 shows that the blend esterifies faster than Heidrun

EXAMPLE 3

The reaction apparatus was the same autoclave used in Example 1. 100 g of Heidrun, 1.51 g of methanol and 116 mg of lithium stearate were put into the autoclave, which then was closed. The autoclave was brought to 350° C. with stirring. After the temperature was reached, samples were taken and titrated according to ASTM D-664. The following table shows the results.

| Time, minutes | Residual Acidity, mg KOH/g |
|---|---|
| 10 | .5 |
| 20 | .4 |
| 30 | .3 |

Comparison with Example 1 shows that addition of lithium stearate accelerates Heidiun esterification.

EXAMPLE 4

The reaction apparatus was the same autoclave described in Example 1. 100 g of Heidrun, 1.51 g of methanol and 52.4 mg of lithium palmitate were put into the autoclave, which was then closed and heated to 350° C. while stirring. After the temperature was reached, samples were taken and titrated with KOH.

The following table gives the results.

| Time, minutes | Residual Acidity, mg KOH/g |
|---|---|
| 10 | 1.0 |
| 20 | .6 |
| 30 | .6 |

Comparison with Example 1 shows that addition of lithium palmitate accelerates esterification.

EXAMPLE 5

The reaction apparatus was the same autoclave described in Example 1. 100 g of Heidrun 222.7 mg of sodium palmitate and 1.51 g of methanol were put into the autoclave, which was closed and heated to 350° C. while stirring. After the autoclave reached the temperature, samples were taken and titrated with KOH.

The following table gives the results.

| Time, minutes | Residual Acidity, mg KOH/g |
|---|---|
| 10 | .5 |
| 20 | .4 |
| 30 | .4 |

Comparison with Example 1 shows that addition of sodium palmitate accelerates esterification.

EXAMPLE 6

The reaction apparatus was the same autoclave used in Example 1. 100 g of Heidrun, 1.51 g of methanol and 111.4 mg of sodium palmitate were put into the autoclave, which was then closed and brought to 350° C. with agitation. After the autoclave reached 350° C., samples were taken and titrated with KOH. The following table gives the results.

| Time, minutes | Residual Acidity, mg KOH/g |
|---|---|
| 10 | .7 |
| 20 | .6 |
| 30 | .5 |

Comparison with Example 1 shows that addition of sodium palmitate accelerates esterification.

EXAMPLE 7

The reaction apparatus was the same autoclave used in Example 1. 100 g of Heidrun, 1.51 g of methanol and 55.7 mg of sodium palmitate were put into the autoclave, which was then closed and heated to 350° C. After the temperature was reached, samples were taken and titrated with KOH. The following table gives the results.

| Time, minutes | Residual Acidity, mg KOH/g |
|---|---|
| 10 | 1.3 |
| 20 | .9 |
| 30 | .8 |

Comparison with Example 1 shows that addition of sodium palmitate accelerates esterification.

EXAMPLE 8

The reaction apparatus was the same autoclave described in Example 1. 100 g of Gryphon, 1.51 g of methanol and 414 mg of a solution of sodium naphathenate in hydrocarbons, containing 4.87% sodium, were put into the autoclave. The autoclave then was closed and heated to 350° C. with agitation, After the autoclave reached 350° C., samples were taken and titrated with KOH. The following table shows the results.

| Time, minutes | Residual Acidity, mg KOH/g |
|---|---|
| 10 | .9 |
| 20 | .7 |
| 30 | .6 |

Comparison with Example 1 shows that addition of sodium naphthenate accelerates esterification.

EXAMPLE 9

In this example, sodium naphthenate was formed in situ by adding sodium hydroxide to Heidrun The reaction apparatus was a 250 ml glass reactor equipped with stirrer and reflux condenser. 120 g of Heidrun, 42 mg of sodium hydroxide and 1.2 g of water were put into the reactor, which was then heated at 100° C. with stirring for 5 hours. After cooling, 100 g of the reaction product and 1.43 g of methanol were put into the autoclave described in Example 1. The autoclave was then closed and heated to 350° C. with agitation. After the autoclave reached 350° C., samples were taken and titrated with KOH. The following table shows the results.

| Time, minutes | Residual Acidity, mg KOH/g |
|---|---|
| 0 | 2.5 |
| 10 | 1.2 |
| 20 | .8 |
| 30 | .5 |

Comparison with Example 1 shows that in situ formation of sodium naphthenate accelerates esterification,

EXAMPLE 10

The reaction apparatus was the same autoclave used in Example 1. 100 g of Heidrun, 1.51 g of methanol and 118 mg of potassium palmitate were put into the autoclave, which was then closed and heated to 350° C. with stirring. After the autoclave reached 350° C., samples were taken and titrated with KOH. The following table shows the results.

| Time, minutes | Residual Acidity, mg KOH/g |
|---|---|
| 10 | .7 |
| 20 | .6 |
| 30 | .5 |

Comparison with Example 1 shows that addition of potassium palmitate accelerates esterification.

EXAMPLE 11

The reaction apparatus was the same as in Example 1. 100 g of Heidrun, 1.51 g of methanol and 451 mg of a hydrocarbon solution of potassium naphthenate, containing 7.25 weight % of potassium, were put into the autoclave, which was then closed and brought to 350° C. With stirring. When the temperature reached 350° C., samples were taken and titrated with KOH. The following table gives the results.

| Time, minutes | Residual Acidity, mg KOH/g |
|---|---|
| 10 | .8 |
| 20 | .6 |
| 30 | .6 |

Comparison with Example 1 shows that addition of potassium naphthenate accelerates esterification

EXAMPLE 12

The reaction apparatus was the same autoclave used in Example 1. 100 g of Heidrun, 1.51 g of methanol and 194 mg of a 5 wt % solution of magnesium naphthenate in hydrocarbons were put into the autoclave, which was then closed and heated to 350° C. with stirring. After the autoclave reached 350° C., samples were taken and titrated with KOH. The following table gives the results,

| Time, minutes | Residual Acidity, mg KOH/g |
|---|---|
| 10 | .6 |
| 20 | .6 |
| 30 | .6 |

Comparison with Example 1 shows that addition of magnesium naphthenate accelerates esterification.

EXAMPLE 13

The reaction apparatus was the same autoclave as in Example 1. 100 g of Heidrun, 1.51 g of methanol and. 103 mg of a 5 wt % hydrocarbon solution of magnesium naphthenate were put into the autoclave, which was then closed and heated to 350° C. with agitation. After the temperature reached 350° C., samples were taken and titrated with KOH. The following table gives the results.

| Time, minutes | Residual Acidity, mg KOH/g |
|---|---|
| 10 | .4 |
| 20 | .4 |
| 30 | .4 |

Comparison with Example 1 shows that addition of magnesium naphthenate accelerates esterification.

EXAMPLE 14

The reaction apparatus was the same autoclave used in Example 1. 100 g of Heidrun, 1.51 g of methanol and 49 mg of a 5 wt % hydrocarbon solution of magnesium naphthenate were loaded into the autoclave, which was then closed and heated to 350° C. while stirring. After the temperature reached 350° C., samples were taken and titrated with KOH. The following table gives the results.

| Time, minutes | Residual Acidity, mg KOH/g |
|---|---|
| 10 | 1.0 |
| 20 | .7 |
| 30 | .6 |

Comparison with Example 1 shows that addition of magnesium naphthenates accelerates esterification.

EXAMPLE 15

The reaction apparatus was the same autoclave as in Example 1. 100 g of Heidrun, 760 mg of methanol and 197 mg of a 5 wt % hydrocarbon solution of magnesium naphthenate were put into the autoclave, which was closed and heated to 350° C. Q with stirring. After the temperature reached 350° C., samples were taken and titrated with KOH. The following table gives the results.

| Time, minutes | Residual Acidity, mg KOH/g |
|---|---|
| 10 | .9 |
| 20 | .9 |
| 30 | .9 |

Comparison with Example 1 shows that addition of magnesium naphthenate accelerates esterification.

EXAMPLE 16

The reaction apparatus was the same autoclave used in Example 1. 100 g of Heidrun, 1.51 g of methanol and 428 mg of a 4 wt % solution of calcium naphthenate in mineral spirits were put into the autoclave. The autoclave was then closed and heated to 350° C. while stirring. After the temperature was reached, samples were taken and titrated with KOH. The following table gives the results.

| Time, minutes | Residual Acidity, mg KOH/g |
|---|---|
| 10 | .8 |
| 20 | .6 |
| 30 | .6 |

Comparison with Example 1 shows that addition of calcium naphthenate accelerates esterification.

EXAMPLE 17

The reaction apparatus was the same autoclave as in Example 1. 100 g of Heidrun, 1.51 g of methanol and 232 mg of a 4 wt % solution of calcium naphthenate in mineral spirits were loaded into the autoclave, which was then closed and heated to 350° C. with agitation. After the autoclave reached 350° C., samples were taken and titrated with KOH. The following table gives the results.

| Time, minutes | Residual Acidity, mg KOH/g |
|---|---|
| 10 | .8 |
| 20 | .6 |
| 30 | .6 |

Comparison with Example 1 shows that addition of calcium naphthenate accelerates esterification.

EXAMPLE 18

The reaction apparatus was the same autoclave as in Example 1. 100 g of Heidrun, 1.51 g of methanol and 110 mg of a 4 wt % solution of calcium naphthenate in mineral spirits were put into the autoclave, which was then closed and brought to 350° C. with agitation. After the temperature was reached, samples were taken and titrated with KOH. The following table gives the results.

| Time, minutes | Residual Acidity, mg KOH/g |
|---|---|
| 10 | 1.1 |
| 20 | .8 |
| 30 | .7 |

Comparison with Example 1 shows that addition of calcium naphthenate accelerates esterification.

EXAMPLE 19

This example shows that calcium naphthenate can be formed in situ by addition of calcium oxide to the crude. The reaction apparatus was a 250 ml glass vessel, equipped with mechanical stirrer, reflux condenser and thermometer. 120 g of Heidrun, 1.2 g of water and 27 mg of calcium oxide were put into the reactor, which was then stirred at 100° C., for 5 hours. After cooling, the contents were transferred to the 300 ml autoclave described in Example 1. 1.43 g of methanol were added, then the autoclave was closed and brought to 350° C. with agitation. After the temperature was reached, samples were taken and titrated with KOH. The following table gives the results.

| Time, minutes | Residual Acidity, mg KOH/g |
|---|---|
| 10 | 1.0 |
| 20 | .7 |
| 30 | .4 |

Comparison with Example 1 shows that calcium naphthenate formed in situ accelerates esterification.

EXAMPLE 20

The reaction apparatus is the same autoclave used in Example 1. 100 g of Heidrun, 1.48 g of methanol and 91 mg of scandium acetylacetonate were put into the autoclave, which was then closed and heated to 350° C. with agitation. After the temperature was reached, samples were taken and titrated with KOH. The following table gives the results.

| Time, minutes | Residual Acidity, mg KOH/g |
|---|---|
| 10 | .6 |
| 20 | .5 |
| 30 | .5 |

Comparison with Example 1 shows that scandium naphthenate formed in situ accelerates esterification.

EXAMPLE 21

The reaction apparatus was the same autoclave used in Example 1. 100 g of Heidrun, 1.485 g of methanol and 152 mg of lanthanum octanoate were put into the autoclave, which was then closed and heated to 350° C. with stirring. After the temperature was reached, samples were taken and titrated with KOH. The following table gives the results,

| Time, minutes | Residual Acidity, mg KOH/g |
|---|---|
| 10 | .4 |
| 20 | .4 |
| 30 | .4 |

Comparison with Example 1 shows that lanthanum carboxylates accelerate esterification.

EXAMPLE 22

The reaction apparatus was the same autoclave as in Example 1. 100 g of Heidrun, 1.51 g of methanol and 38 mg of lanthanum octanoate were put into the autoclave, which was then closed and heated to 350° C. with agitation. After the autoclave reached 350° C., samples were taken and titrated with KOH. The following table gives the results.

| Time, minutes | Residual Acidity, mg KOH/g |
|---|---|
| 10 | 1.1 |
| 20 | .8 |
| 30 | .7 |

Comparison with Example 1 shows that addition of a lanthanum. carboxylate accelerates esterification.

EXAMPLE 23

The reaction apparatus was the autoclave used in Example 1. 100 g of Heidrun, 1.51 g of methanol and 152 mg of cerous 2-ethylhexanoate were put into the autoclave, which was then closed and heated to 350° C. with agitation. After the temperature was reached, samples were taken and titrated with KOH. The following table gives the results.

| Time, minutes | Residual Acidity, mg KOH/g |
|---|---|
| 10 | .7 |
| 20 | .6 |
| 30 | .6 |

EXAMPLE 24

The reaction apparatus was the same autoclave as in Example 1. 100 g of Heidrun, 1.485 g of methanol and 105 mg of titanyl acetylacetonate were loaded into the autoclave, which was then closed and heated to 350° C. while stirring. After the temperature was reached, samples were taken and titrated with KOH. The following table gives the results.

| Time, minutes | Residual Acidity, mg KOH/g |
|---|---|
| 10 | .5 |
| 20 | .5 |
| 30 | .5 |

Comparison with Example 1 shows that addition of a titanium compound accelerates esterification.

EXAMPLE 25

The reaction apparatus was the same autoclave used in Example 1. 100 g of Heidrun, 1.485 g of methanol and 97.6 mg of zirconium acetylacetonate were put into the autoclave, which was then closed and brought to 350° C. while stirring. After the temperature was reached, samples were taken and titrated with KOH. The following table shows the results.

| Time, minutes | Residual Acidity, mg KOH/g |
|---|---|
| 10 | .4 |
| 20 | .3 |
| 30 | .3 |

Comparison with Example 1 shows that in situ formation of zirconium naphthenates accelerates esterification.

EXAMPLE 26

The reaction apparatus was the autoclave described in Example 1. 100 g of Heidrun, 1.485 g of methanol and 24.4 mg of zirconium acetylacetonate were put into the autoclave, which was then closed and heated to 350° C. with agitation. After the temperature was reached, samples were taken and titrated with KOH. The following table gives the results.

| Time, minutes | Residual Acidity, mg KOH/g |
|---|---|
| 10 | 1.0 |
| 20 | .7 |
| 30 | .6 |

Comparison with Example 1 shows that in situ formation of zirconium naphthenates accelerates esterification.

EXAMPLE 27

The reaction apparatus was the autoclave described in Example 1. 100 g of Heidrun, 1.51 g of methanol and 380 mg of a hydrocarbon solution of manganese naphthenate, containing 6 wt % manganese, were put into the autoclave, which was then closed and heated to 350° C. After the autoclave reached 350° C., samples were taken and titrated with KOH. The following table results.

| Time, minutes | Residual Acidity, mg KOH/g |
|---|---|
| 10 | .5 |
| 20 | .4 |
| 30 | .4 |

Comparison with Example 1 shows that addition of manganese naphthenate accelerates esterification.

Examination by infrared spectroscopy shows the presence of a band at 1742 $cm^{-1}$, not present in untreated Heidrun and attributed to ester groups. A band around 1710 $cm^{-1}$ remains essentially unchanged when the sample is treated with triethylamine. Therefore the band is due to ketogroups and not to residual acidity.

EXAMPLE 28

The reaction apparatus is the same autoclave used in Example 1. 100 g of Heidrun, 1.485 g of methanol and 91.7 mg of a hydrocarbon solution of manganese naphthenate, containing 6 wt % of manganese, were loaded into the autoclave, which was then closed and heated to 350° C. After the temperature was reached, samples were taken and titrated with KOH. The following table gives the results.

| Time, minutes | Residual Acidity, mg KOH/g |
|---|---|
| 10 | .9 |
| 20 | .7 |
| 30 | .7 |

Comparison with Example 1 shows that addition of manganese naphthenate accelerates esterification.

EXAMPLE 29

The reaction apparatus was the same as in Example 1. 100 g of Heidrun, 1.48 g of methanol and 86.4 mg of aluminum acetylacetonate were put into the autoclave, which was then closed and heated with agitation. After the temperature reached 350° C., samples were taken and titrated with KOH. The following table gives the results.

| Time, minutes | Residual Acidity, mg KOH/g |
|---|---|
| 10 | 1.0 |
| 20 | .9 |
| 30 | .9 |

Comparison with Example 1 shows that in situ formation of aluminum naphthenate accelerates esterification.

EXAMPLE 30

The reaction apparatus was the same autoclave in Example 1. 100 g of Heidrun, 1.5 g of methanol and 162 g of tin ethylhexanoate were put into the autoclave, which was then closed and heated with agitation. After the temperature reached 350° C. samples were taken and titrated with KOH. The following table gives the results.

| Time minutes | Residual Acidity, mg KOH/g |
|---|---|
| 10 | .9 |
| 20 | .8 |
| 30 | .7 |

Comparison with Example 1 shows that addition of an oil-soluble tin compound accelerates esterification.

EXAMPLE 31

The reaction apparatus was the same autoclave used in Example 1. 100 g of Heidrun, 1.51 g of methanol and 113 mg of zinc acetylacetonate were put into the autoclave, which was then closed and heated with agitation. After the temperature reached 350° C., samples were taken and titrated with KOH. The following table gives the results.

| Time minutes | Residual Acidity, mg KOH/g |
|---|---|
| 10 | 1.2 |
| 20 | 1.2 |
| 30 | 1.1 |

Comparison with Example 1 shows that in situ formation of zinc naphthenate accelerates esterification.

EXAMPLE 32

The reaction apparatus was the same autoclave as in Example 1. 100 g of Heidrun, 1.5 g of methanol and 103 mg of cobaltous acetylacetonate were put into the autoclave, which was then closed and heated with agitation. After the temperature reached 350° C., samples were taken and titrated with KOH. The following table gives the results.

| Time minutes | Residual Acidity, mg KOH/g |
|---|---|
| 10 | .6 |
| 20 | .6 |
| 30 | .6 |

Comparison with Example 1 shows that in situ formation of cobaltous naphthenate accelerates esterification.

EXAMPLE 33

The reaction apparatus was the same autoclave used in Example 1. 100 g of Heidrun were put into the autoclave, which was then swept with nitrogen to displace air. 1.51 g of methanol and 26 mg of cobaltous acetylacetonate were added under nitrogen, then the autoclave was closed and pressurized with nitrogen to 105 psi. Then the autoclave was heated with agitation. After the temperature reached 350° C., samples were taken and titrated with KOH. The following table gives the results.

| Time minutes | Residual Acidity, mg KOH/g |
|---|---|
| 10 | .9 |
| 20 | .9 |
| 30 | .9 |

Comparison with Example 1 shows that in situ formation of cobaltous naphthenate accelerates esterification.

EXAMPLE 34

This Example is for comparison only. The reaction apparatus was the same autoclave used in Example 1. 100 g of San Joaquin Valley crude, having a total acid number of 3.8 mg KOH/g, determined according to ASTM D-664, were loaded into the autoclave. 2.17 g of methanol were added, then the autoclave was closed and heated with agitation. After the temperature reached 350° C., samples were taken and titrated with KOH. The following table gives the results.

| Time minutes | Residual Acidity, mg KOH/g |
|---|---|
| 10 | 2.3 |
| 20 | 2.1 |
| 30 | 1.8 |

EXAMPLE 35

The reaction apparatus was the same as in Example 1. 100 g of San Joaquin Valley crude, 2.17 g of methanol and 200 mg of a solution of calcium naphthenate in mineral spirits containing 4 wt % calcium were put into the autoclave. The autoclave was then closed and heated to 350° C. with Stirring. After the temperature was reached, samples were taken and titrated with KOH. The following table gives the results.

| Time minutes | Residual Acidity, mg KOH/g |
|---|---|
| 10 | 1.0 |
| 20 | .6 |
| 30 | .6 |

Comparison with Example 34 shows that addition of calcium naphthenate accelerates esterification.

EXAMPLE 36

The reaction apparatus was the same as in Example 1. 100 g of Heidrun, 1.485 g of methanol and 249 mg of ferrous stearate were put into the autoclave, which was then closed and heated with agitation. After the temperature reached 350° C., samples were taken and titrated with KOH. The following table gives the results.

| Time minutes | Residual Acidity, mg KOH/g |
|---|---|
| 10 | 1.6 |
| 20 | 1.4 |
| 30 | 1.2 |

Comparison with Example 1 shows that addition of a ferrous carboxylate accelerates esterification.

EXAMPLE 37

The reaction apparatus was the same as in Example 1. 100 g of Heidrun were put into the autoclave and swept with nitrogen. Then 1.51 g of methanol and 150 mg of chromium (II) acetate monohydrate, weighed under nitrogen, were added under a nitrogen blanket. Then the autoclave was closed and heated with stirring. After the temperature reached 350° C., samples were taken and titrated with KOH. The following table gives the results.

| Time minutes | Residual Acidity, mg KOH/g |
|---|---|
| 10 | 1.3 |
| 20 | 1.2 |
| 30 | 1.0 |

Comparison with Example 1 shows that addition of a chromium (II) compound accelerates esterification.

What is claimed is:

1. A process for reducing the acidity of a petroleum oil containing organic acids comprising treating said petroleum oil containing organic acids with an effective amount of an alcohol at a temperature and under conditions sufficient to form the corresponding ester of the said alcohol and wherein said treatment is conducted in the presence of a metal carboxylate; with the proviso that said petroleum oil containing organic acids is an acidic whole crude oil or crude oil fraction, and said alcohol is selected from the group consisting of alkanols, alkane diols, and mixtures thereof.

2. The process of claim 1 wherein the petroleum oil containing organic acid is a petroleum oil containing naphthenic acid.

3. The process of claim 1 wherein the process is carried out at a temperature, ranging from about ambient to about 450° C.

4. The process of claim 1 wherein said alkane diols are $C_2$ to $C_6$ alkane diols.

5. The process of claim 1 wherein the molar ratio of alcohol to organic acid in the petroleum feed is about 0.5 to about 20.

6. The process of claim 1 wherein said metal carboxylate is added to said petroleum oil or is formed in situ in said petroleum oil.

7. The process of claim 1 wherein said metal carboxylates are selected from the groups consisting of metal naphthenates, metal stearates, metal palmitates and mixtures thereof.

8. The process of claim 1 wherein the amount of metal carboxylate ranges from about 0.5 to about 20 milliequivalents of metal carboxylate per kg of petroleum oil being treated.

9. The process of claim 1 wherein said metal carboxylates are metal carboxylates of metals selected from the group consisting of metals of Groups IA, IIA, IIIA, IIIB, IVA, IVB, VIIB, and VIIIB of the periodic table of elements and mixtures thereof.

10. The process of claim 9 wherein said metal of said metal carboxylate is selected from the group consisting of Li, Na, K, Mg, Ca, Sc, La, Ti, Zr, Mn, Co, Al, Cs, and mixtures thereof.

11. The process of claim 1 wherein said alkanol is selected from $C_1$ to $C_6$ alkanols.

12. The process of claim 11 wherein said alkanol is methanol, ethanol and mixtures thereof.

13. The process of claim 12 wherein said alkanol is methanol.

* * * * *